US007156477B1

(12) United States Patent
Lu

(10) Patent No.: US 7,156,477 B1
(45) Date of Patent: Jan. 2, 2007

(54) RELEASE-CONTROL STOP MEMBER OF A SLIDING RAIL ASSEMBLY FOR DRAWER

(76) Inventor: Chun-Min Lu, 1F., No. 12, Alley 12, Lane 151, Sha-Lun Rd., Tamshui Chen, Taipei Hsien (TW)

( * ) Notice: Subject to any disclaimer, the term of this patent is extended or adjusted under 35 U.S.C. 154(b) by 265 days.

(21) Appl. No.: 10/863,281

(22) Filed: Jun. 9, 2004

(51) Int. Cl.
*A47B 88/00* (2006.01)

(52) U.S. Cl. ..... 312/333; 312/334.46

(58) Field of Classification Search ..... 312/332.1, 312/333, 334.1, 334.7, 334.8, 334.9, 334.11, 312/334.44, 334.46, 334.47, 319.1; 384/21, 384/22

See application file for complete search history.

(56) References Cited

U.S. PATENT DOCUMENTS 5,722,750 A * 3/1998 Chu ..... 312/334.11
5,730,514 A * 3/1998 Hashemi ..... 312/333
6,126,255 A * 10/2000 Yang ..... 312/334.46
6,402,275 B1 * 6/2002 Yang ..... 312/334.46
6,412,891 B1 * 7/2002 Liang et al. ..... 312/334.44
6,729,703 B1 * 5/2004 Le ..... 312/333
6,824,233 B1 * 11/2004 Chen et al. ..... 312/334.46
6,926,377 B1 * 8/2005 Lammens et al. ..... 312/333
2002/0043915 A1 * 4/2002 Chan ..... 312/334.46

* cited by examiner

*Primary Examiner*—Janet M. Wilkens
(74) *Attorney, Agent, or Firm*—Troxell Law Offices PLLC

(57) ABSTRACT

A release control stop member injection-molded from plastics and affixed to a first sliding rail being inserted into a second sliding rail having a locating block for stopping the first sliding rail from falling out of the second sliding rail is disclosed to have a flat rear engagement block affixed to the first sliding rail, a locating notch at a front side of the flat rear engagement block for engagement with the locating block of the second sliding rail to stop the first sliding rail from falling out of the second sliding rail, an arched neck, and a front operating handle connected to the flat rear engagement block through the arched neck for pulling axially forwards with the hand to deform the arched neck and to further disengage the locating notch from the locating block for enabling the first sliding rail to be disconnected from the second sliding rail.

3 Claims, 11 Drawing Sheets

RELEASE-CONTROL STOP MEMBER OF A SLIDING RAIL ASSEMBLY FOR DRAWER

BACKGROUND AND SUMMARY OF THE INVENTION

The present invention relates to a release-control stop member for use in a sliding rail assembly to stop the inner sliding rail from falling out of the intermediate sliding rail and more particularly, to such a release-control stop member that can easily be operated with less effort to release the inner sliding rail from the intermediately sliding rail.

FIGS. 1~3 show a sliding rail assembly for drawer according to the prior art. According to this design, the sliding rail assembly comprises a locating block 61 fixedly provided at the front open side of the intermediate sliding rail 6, and a release-control stop member 8 provided at the inner sliding rail 7 for stopping the inner sliding rail 7 from falling out of the intermediate sliding rail 6. The locating block 61 has a protruded retaining portion 611. The release-control stop member 8 has a stop portion 80 for engagement with the retaining portion 611 of the locating block 61, and a finger rod 81 for turning by hand to disengage the stop portion 80 from the retaining portion 611 of the locating block 61. This design of release-control stop member 8 has drawbacks as follows:

1. When wishing to separate the inner sliding rail 7 from the intermediate sliding rail 6, the user must turn the finger rod 81 upwards or downwards subject to the install direction of the release-control stop member 8 in the inner sliding rail 7 so as to disengage the stop portion 80 from the protruded retaining portion 611 of the locating block 61. However, it is not convenient to turn the finger rod 81 upwards or downwards in a narrow space.
2. When disconnecting the inner sliding rail 7 from the intermediate sliding rail 6, the user must turn the finger rod 81 upwards or downwards subject to the install direction of the release-control stop member 8 in the inner sliding rail 7 with one hand, and at the same time force the inner sliding rail 7 downwards or upwards with the other hand. Turning the finger rod 81 in the wrong direction cannot disengage the stop portion 80 from the protruded retaining portion 611 of the locating block 61.

The present invention has been accomplished under the circumstances in view. It is therefore the main object of the present invention to provide a release-control stop member for use in a sliding rail assembly for drawer that eliminates the aforesaid drawbacks. According to the present invention, the release-control stop member is affixed to a first sliding rail being inserted into a second sliding rail having a locating block for stopping the first sliding rail from falling out of the second sliding rail. The release-control stop member comprises a flat rear engagement block affixed to the first sliding rail, a locating notch at a front side of the flat rear engagement block for engagement with the locating block of the second sliding rail to stop the first sliding rail from falling out of the second sliding rail, an arched neck, and a front operating handle connected to the flat rear engagement block through the arched neck for pulling by the user to deform the arched neck and to further disengage the locating notch from the locating block for enabling the first sliding rail to be disconnected from the second sliding rail. When wishing to separate first sliding rail from the second sliding rail, the user can pull the operating handle of the release-control stop member with the fingers with less effort. Simply pulling a flat front operating portion of the front operating handle of the release-control stop member straightly forwards, the arched neck is deformed to force the locating notch away from the locating block of the second sliding rail. Further, the release-control stop member is a single piece element directly injection-molded from plastics for quick installation with less labor, thereby lowering the cost.

DETAILED DESCRIPTION OF THE INVENTION

Figure 1:
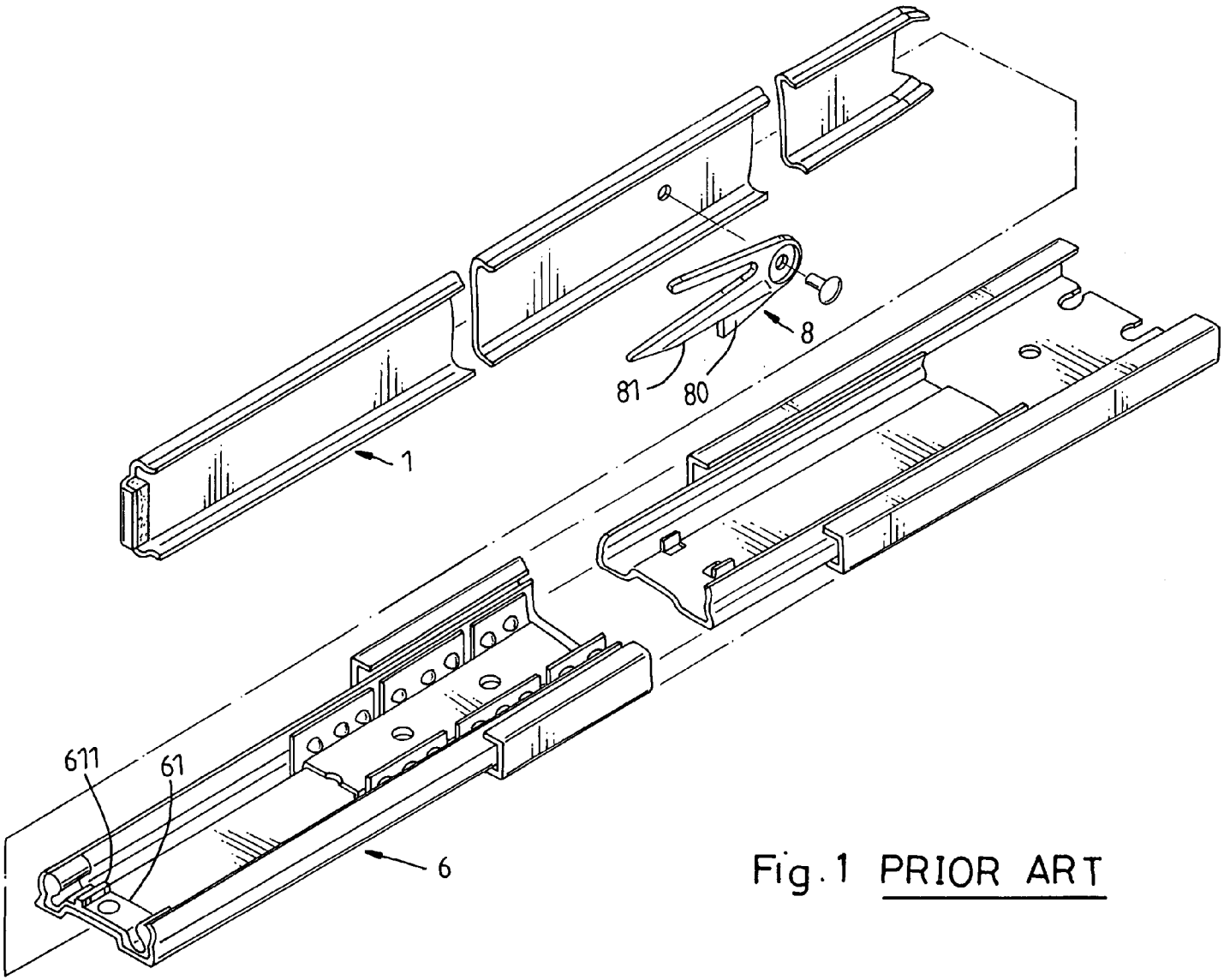
Fig. 1 PRIOR ART
FIG. 1 is an exploded view of a sliding rail assembly for drawer according to the prior art.
Figure 2:
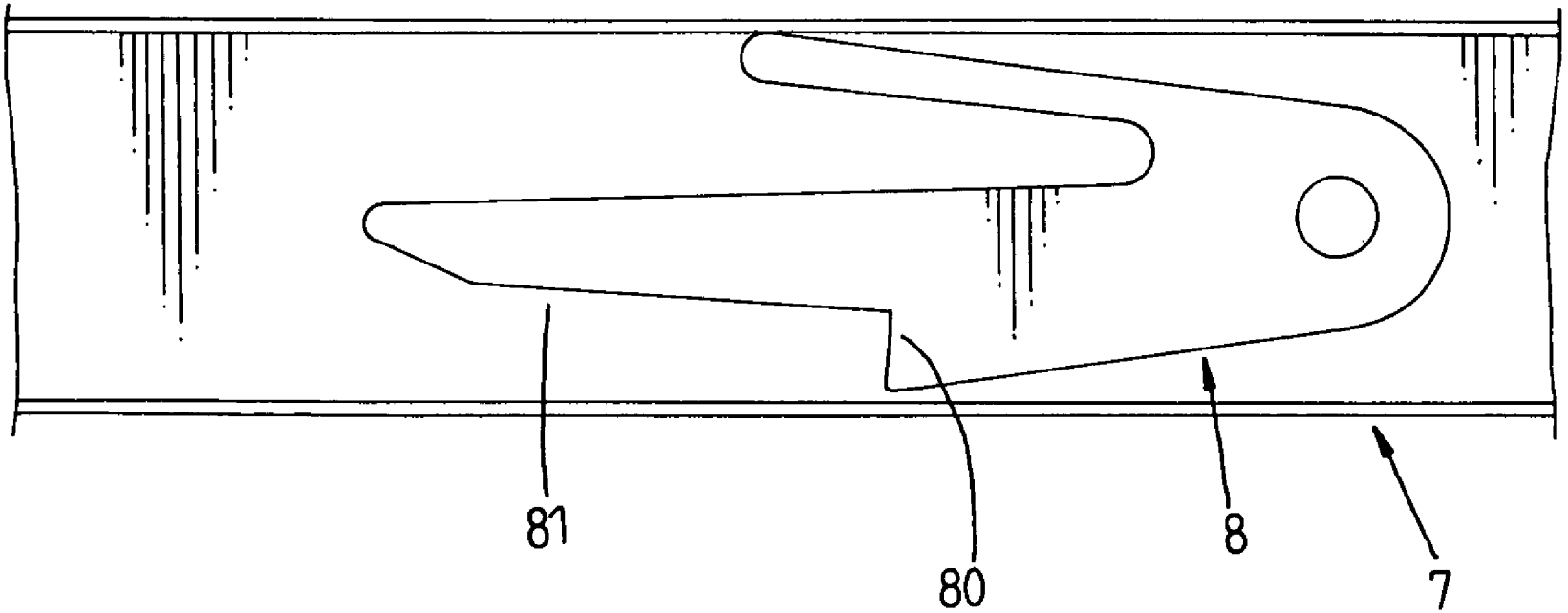
Fig. 2 PRIOR ART
FIG. 2 is a plain view showing the release-control stop member positioned in the sliding rail in one direction according to the prior art.
Figure 3:
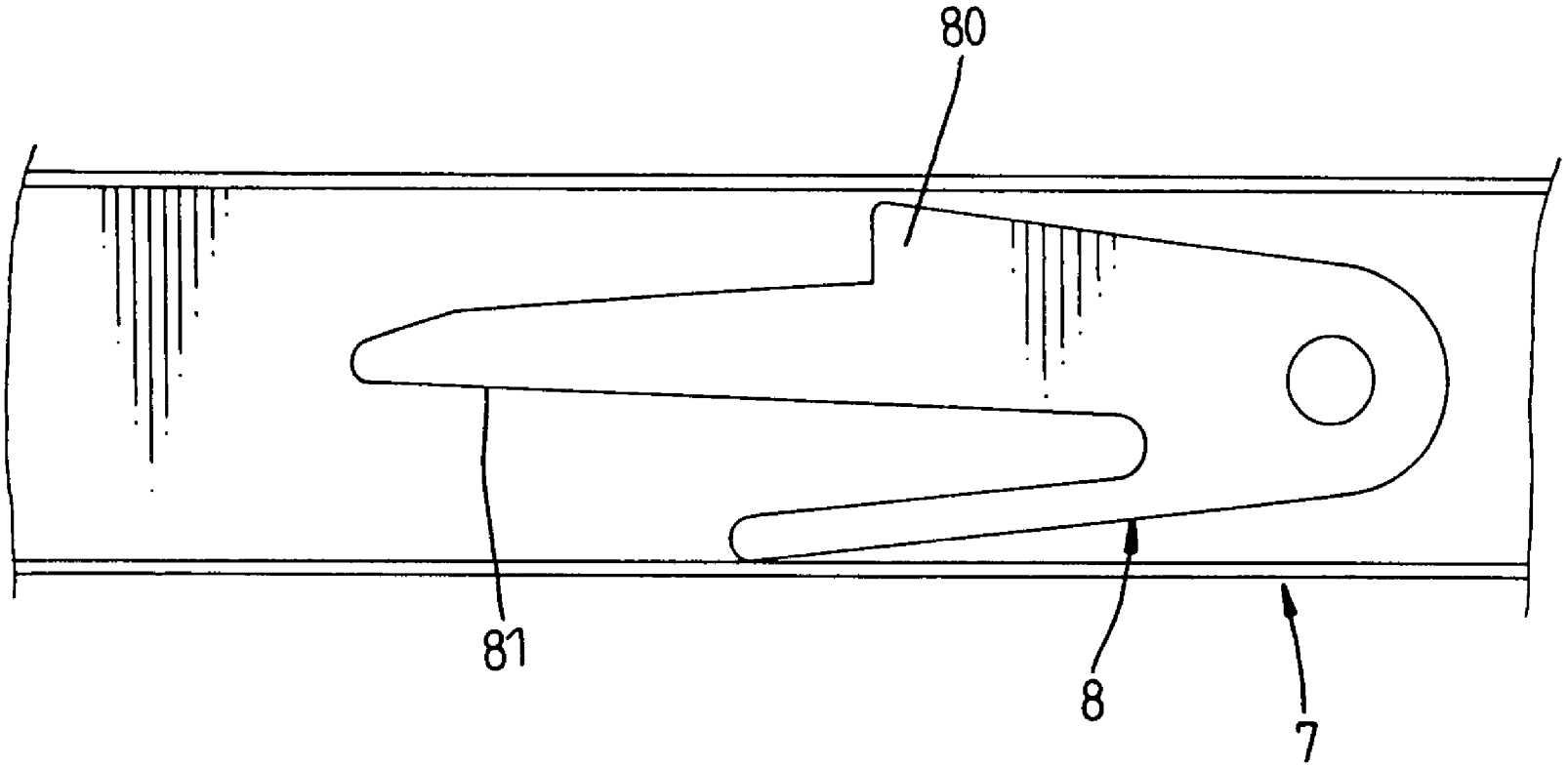
Fig. 3 PRIOR ART
FIG. 3 is similar to FIG. 2 but showing the position o the release-control stop member reversed.
Figure 4:
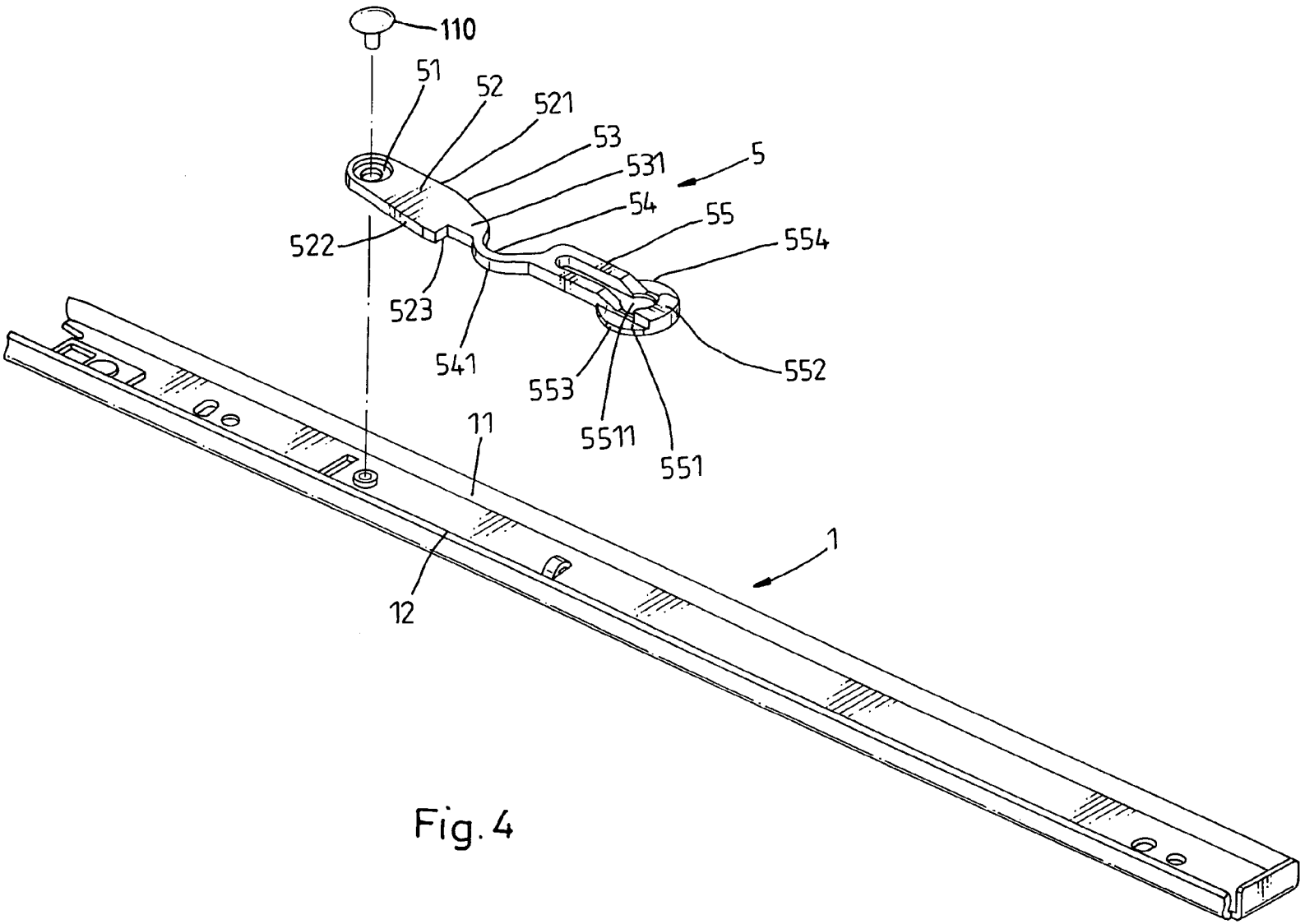
FIG. 4 is an exploded view of a release-control stop member and an inner sliding rail according to the present invention.
Figure 5:
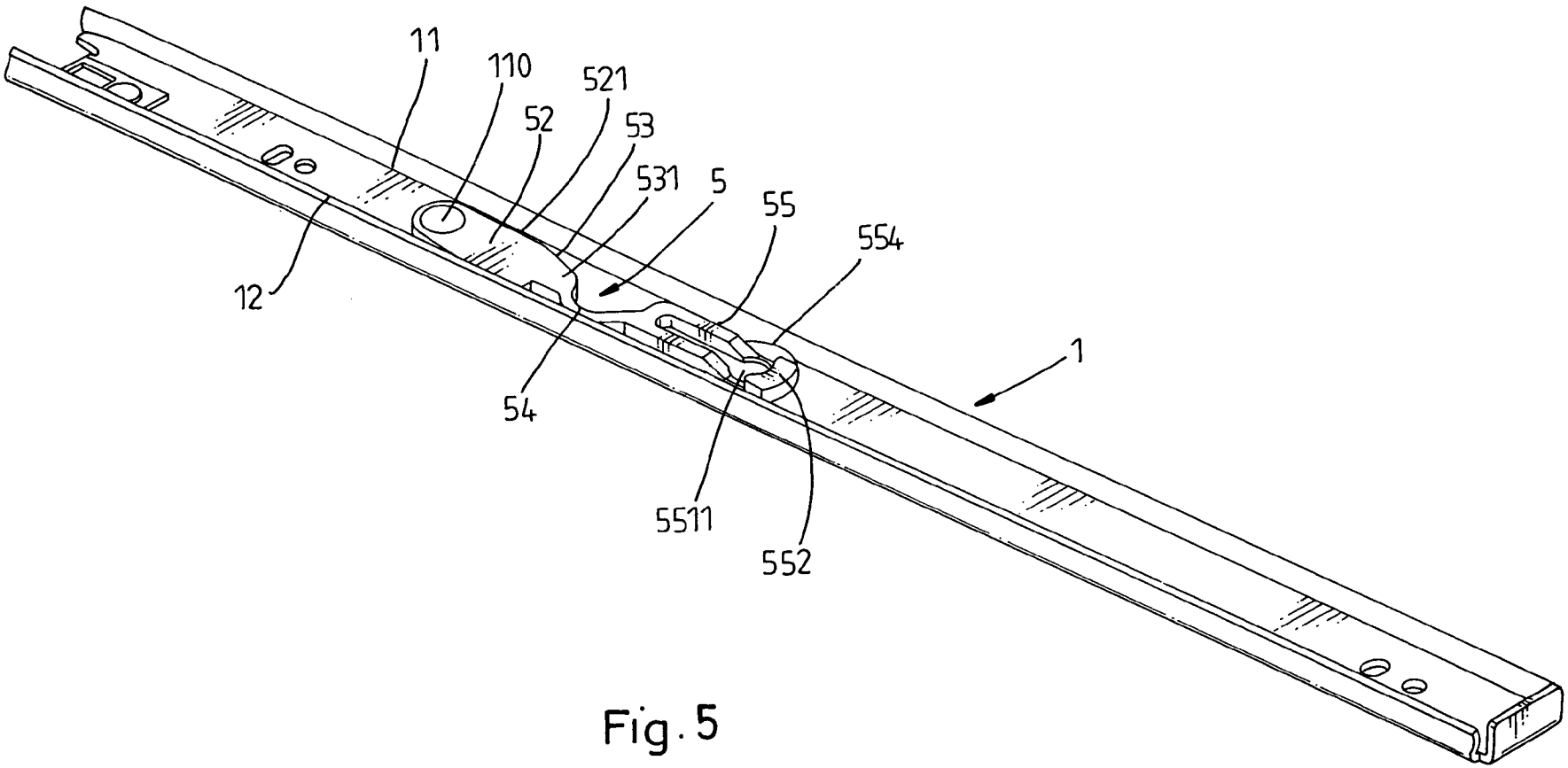
FIG. 5 is an assembly view of FIG. 4.
Figure 6:
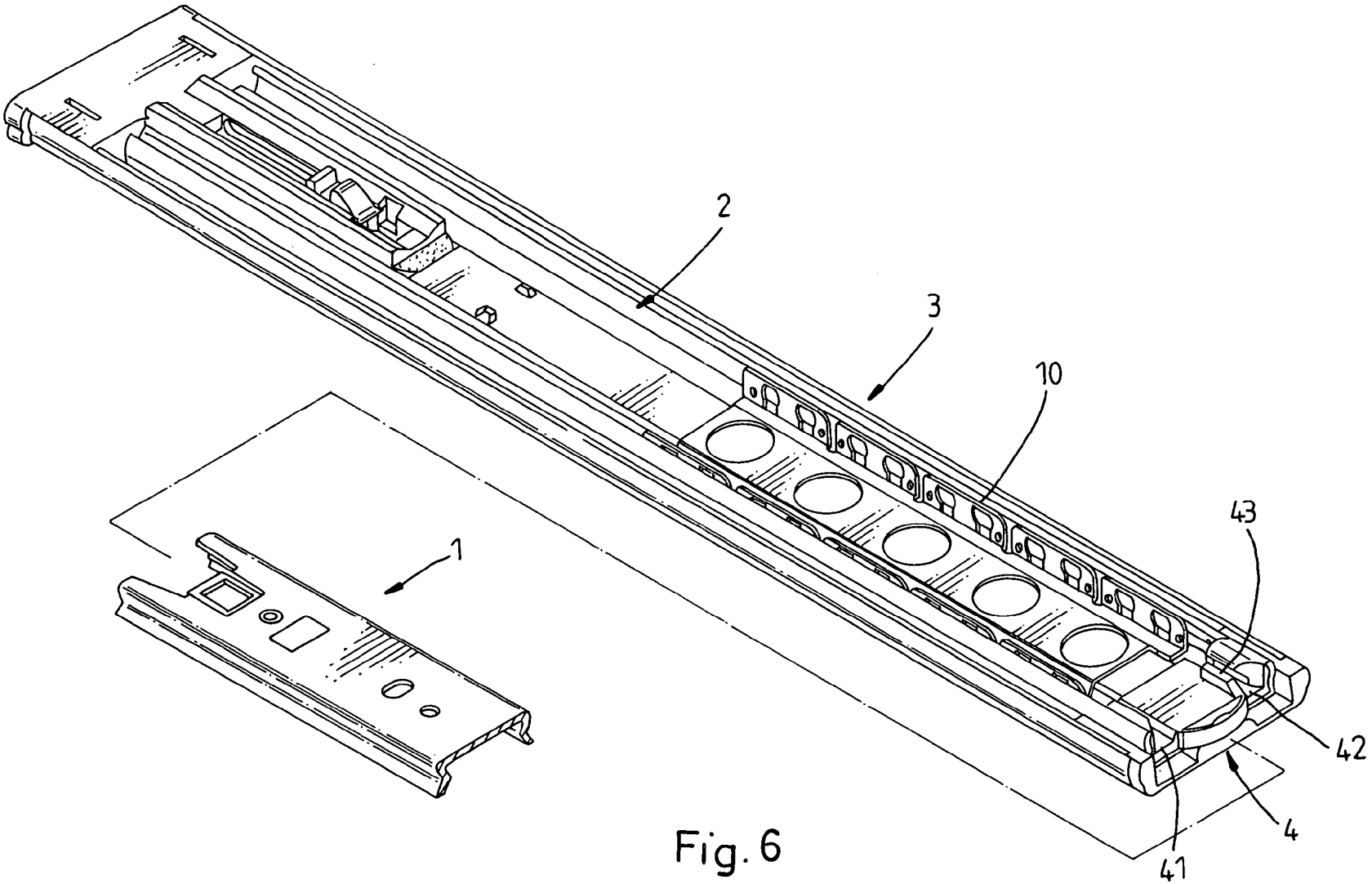
FIG. 6 is an exploded view after installation of the release-control stop member in the inner sliding rail before installation of the inner sliding rail in the intermediate sliding rail at the outer rail according to the present invention.
Figure 7:
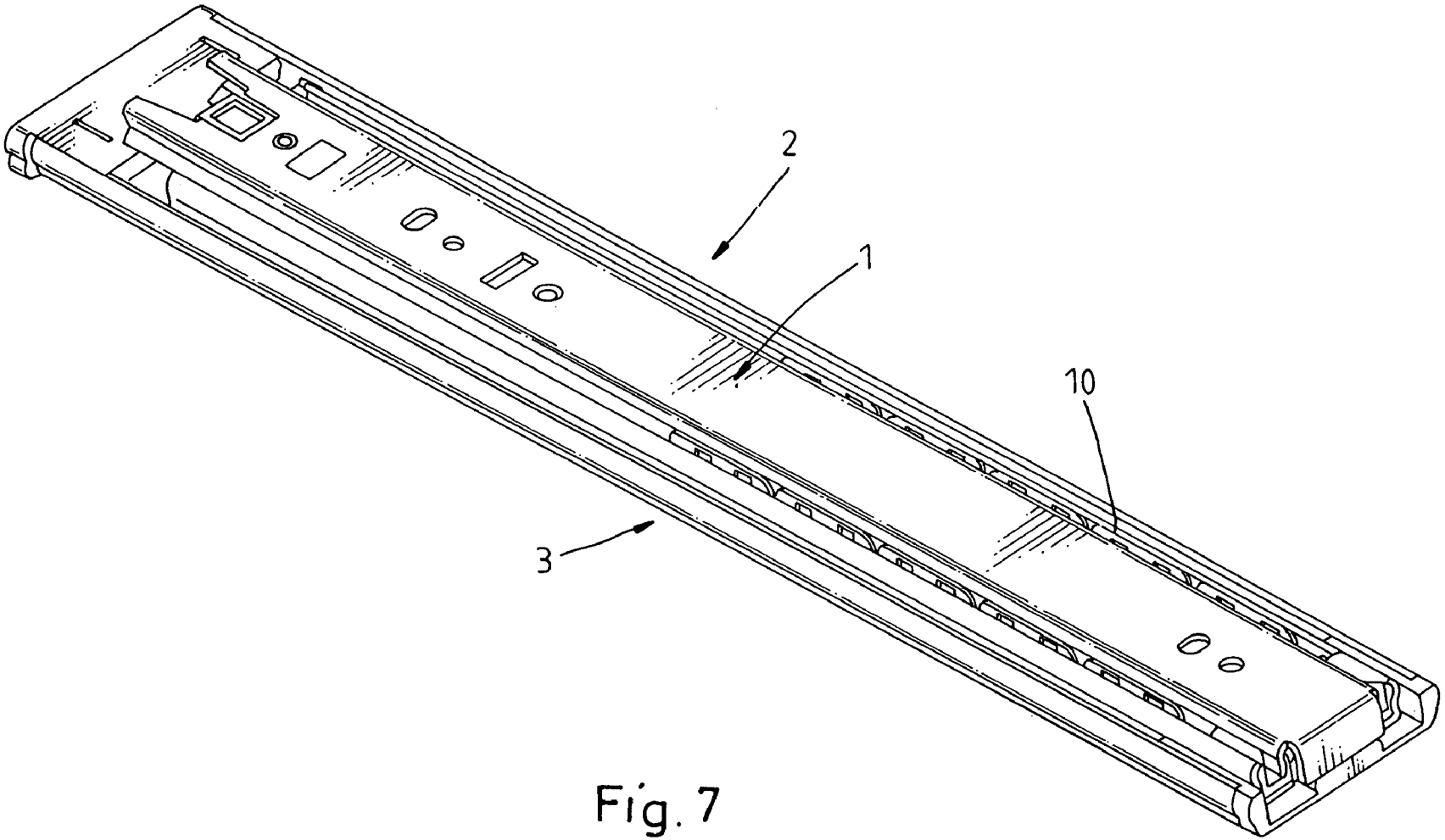
FIG. 7 is an assembly view of FIG. 6.

Referring to FIGS. 4~11, a release-control stop member 5 is shown used in a sliding rail assembly for drawer. According to the present preferred embodiment, the sliding rail assembly comprises an inner sliding rail 1, an intermediate sliding rail 2, outer rail 3, a first bushing 10 set between the inner sliding rail 1 and the intermediate sliding rail 2, and a second bushing (not shown) set between the intermediate sliding rail 2 and the outer rail 3. The outer rail 3 is fixedly mounted inside a desk (not shown). The inner sliding rail 1 is affixed to one sidewall of a drawer and axially movable with the drawer in and out of the desk. The intermediate sliding rail 2 has a locating block 4 fixedly provided at the front open end. The locating block 4 has two longitudinal sliding grooves 41, 42 arranged in parallel at two sides, and a retaining portion 43 upwardly protruded from the top side thereof adjacent to one sliding groove 41. The release-control stop member 5 is fastened to the inner sliding rail 1 near the rear end between the two opposite vertical sidewalls 11, 12 of the inner sliding rail 1. When pulling the drawer out of the desk, the release-control stop member 5 will be moved with the inner sliding rail 1 and then stopped at the retaining portion 43 of the locating block 4, preventing falling of the inner sliding rail 1 out of the intermediate sliding rail 2.

Figure 8:
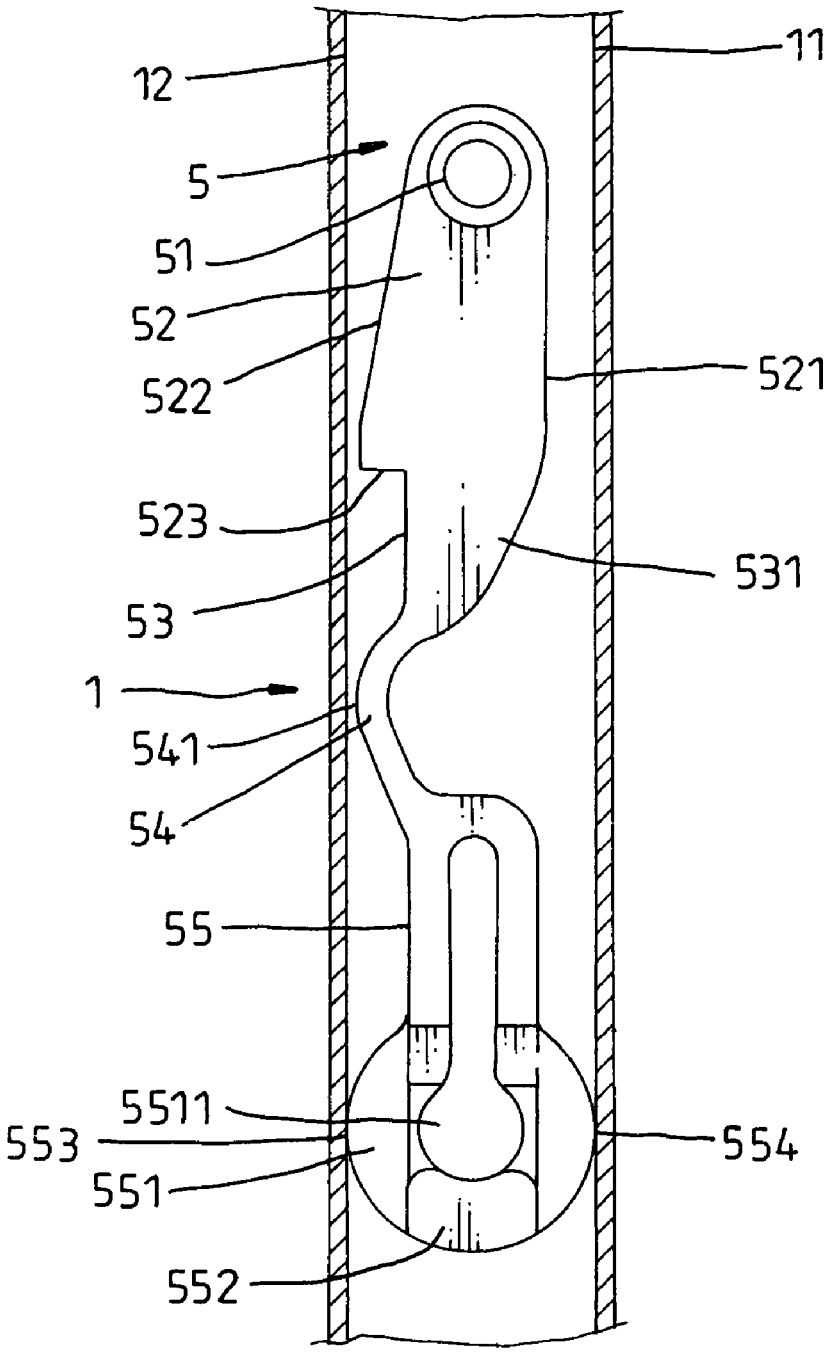
FIG. 8 is a plain view showing the release-control stop member positioned in the inner sliding rail according to the present invention.
Figure 9:
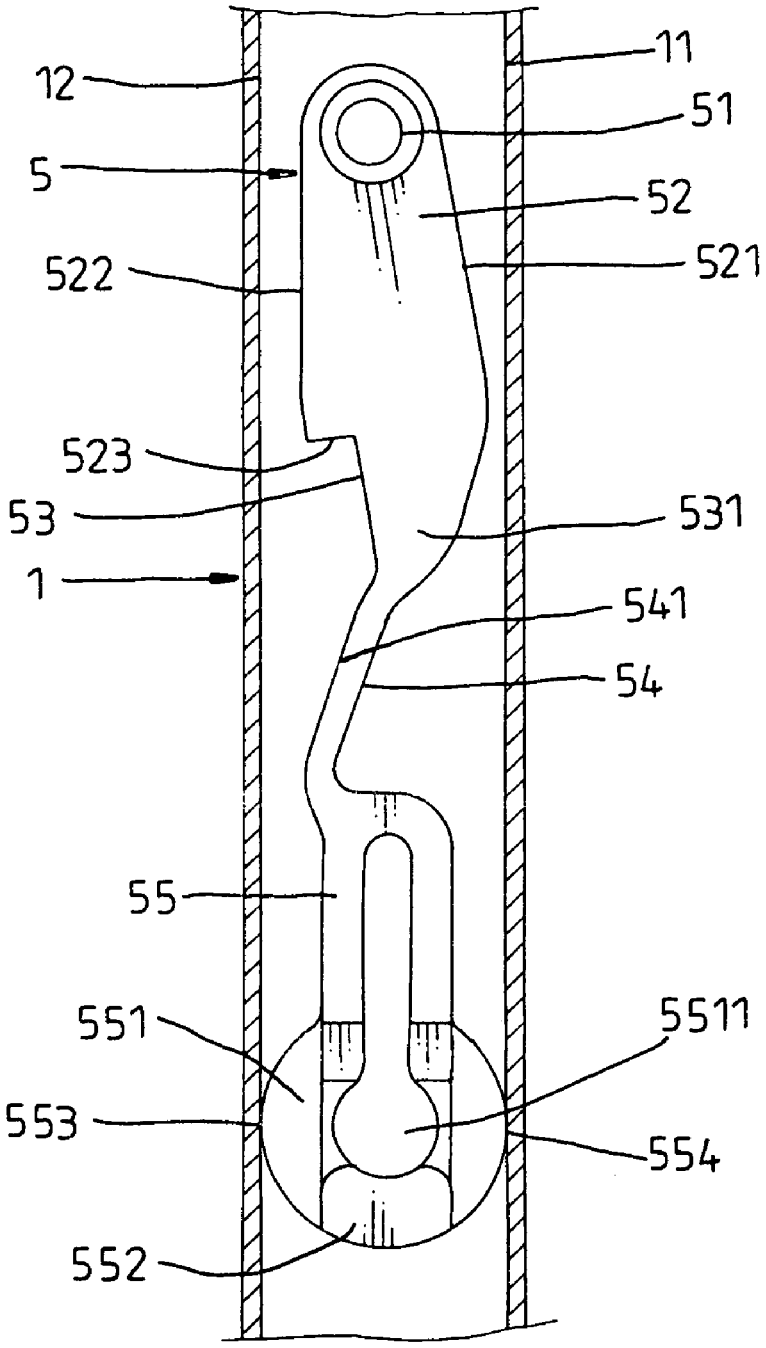
FIG. 9 is similar to FIG. 8 but showing the release-control stop member pulled, the arched neck deformed (straightened).

The release-control stop member 5 comprises a flat rear engagement block 52, a front operating handle 55, and a neck 54 connected between the flat rear engagement block 52 and the front operating handle 55 (see FIG. 8). The flat rear engagement block 52 has a rear mounting hole 51 fastened to the inner sliding rail 1 near the rear end with a fastening member 110, a first side edge 521, a second side edge 522, a narrow front connecting portion 53, and a locating notch 523 defined between the second side edge 522 and the narrow front connecting portion 53. The first side edge 521 is disposed adjacent to the first vertical sidewall 11 of the inner sliding rail 1, and spaced from the first vertical sidewall 11 of the inner sliding rail 1 at a distance. The second side edge 522 of the flat rear engagement block 52 is disposed adjacent to the second vertical sidewall 12 of the inner sliding rail 1, and extends obliquely backwardly inwards. The narrow front connecting portion 53 has a front end 531 terminating in the rear end of the neck 54. The neck 54 has a smoothly arched middle portion 541 curving toward the second vertical sidewall 12 of the inner sliding rail 1. The front operating handle 55 has a flat front operating portion 551 and a finger block 552 at the flat front operating portion 551. The flat front operating portion 551 is relatively broader than the other part of the front operating handle 55. The width of the flat front operating portion 551 is slightly smaller than the pitch between the upright sidewalls 11, 12 of the inner sliding rail 1.

Figure 10:
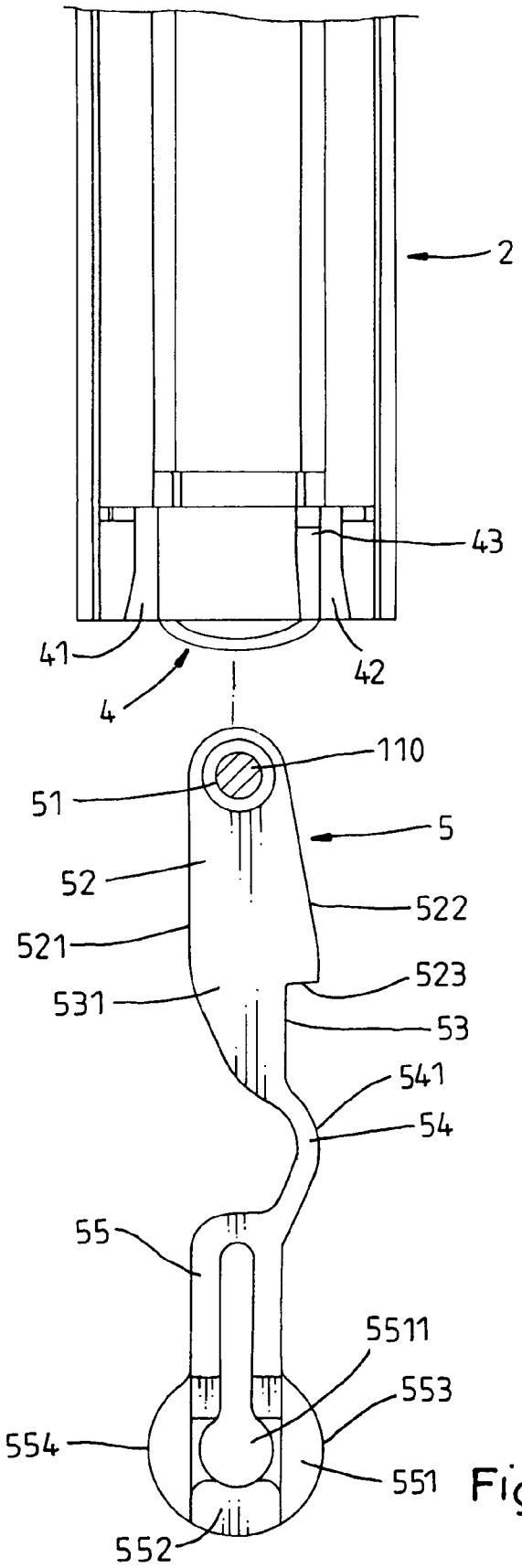
FIG. 10 illustrates the release-control stop member removed from the intermediately sliding rail according to the present invention.
Figure 11:
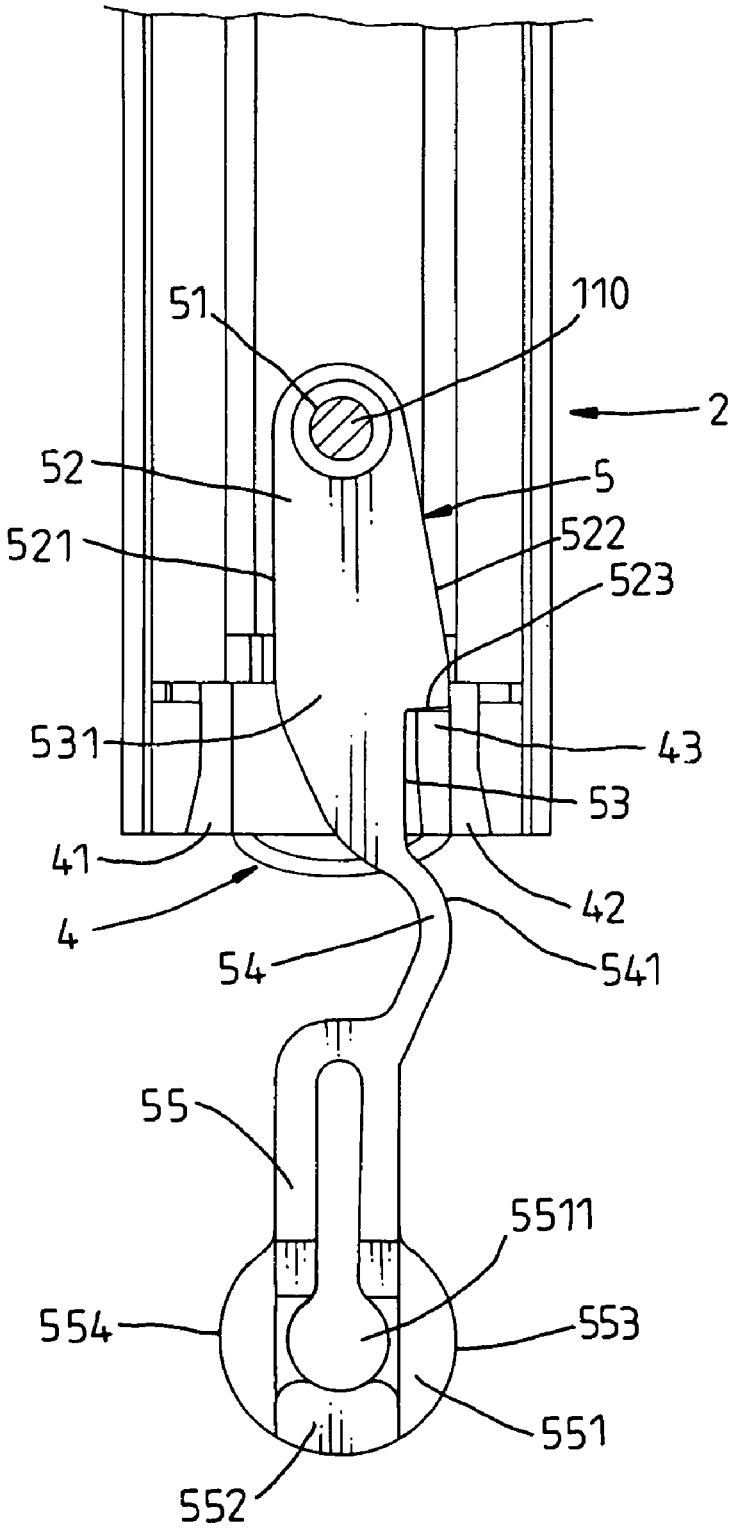
FIG. 11 illustrates the locating notch of the release-control stop member engaged with the retaining portion of the locating block at the intermediate sliding rail according to the present invention.

FIG. 10 is a plain view of the present invention before insertion of the release-control stop member 5 into the intermediate sliding rail 2. When inserted the two vertical sidewalls 11, 12 of the inner sliding rail 1 through the two longitudinal sliding grooves 41, 42 of the locating block 4 into the inside of the intermediate sliding rail 2, the second side edge 522 of the flat rear engagement block 52 of the release-control stop member 5 is moved over the retaining portion 43 of the locating block 4. After the second side edge 522 of the flat rear engagement block 52 of the release-control stop member 5 has been completely moved over the retaining portion 43 of the locating block 4, the springy material property of the plastic material of the release-control stop member 5 immediately returns the release-control stop member 5 to the former shape. If the user pulls the inner sliding rail 1 forwards relative to the intermediate sliding rail 2 after the second side edge 522 of the flat rear engagement block 52 of the release-control stop member 5 has been completely moved over the retaining portion 43 of the locating block 4, the locating notch 523 will be forced into engagement with the retaining portion 43 of the locating block 4 to stop the inner sliding rail 1 from falling out of the intermediate sliding rail 2 (see FIG. 11). When wishing to separate the inner sliding rail 1 from the intermediately sliding rail 2, pull the flat front operating portion 551 of the front operating handle 55 of the release-control stop member 5 to deform (straighten) the arched neck 54 (see FIG. 9) and to further disengage the locating notch 523 from the retaining portion 43 of the locating block 4, and therefore the release-control stop member 5 is disconnected from the intermediate sliding rail 2 (see FIG. 10).

Referring to FIG. 9 again, the flat front operating portion 551 of the front operating handle 55 has two opposite lateral sides 553, 554 smoothly arched to reduce friction resistance between the release-control stop member 5 and the vertical sidewalls 11, 12 of the inner sliding rail 1. Further, for positive gripping of the fingers, the finger block 552 of the front operating handle 55 of the release-control stop member 5 is chamfered, and a slot 5511 is formed in the flat front operating portion 551 of the front operating handle 55 on the middle.

As indicated above, the invention has numerous advantages as outlined hereinafter.

1. By means of pulling the flat front operating portion 551 of the front operating handle 55 of the release-control stop member 5 axially forwards to deform (straighten) the arched neck 54, the locating notch 523 is disengaged from the retaining portion 43 of the locating block 4, and therefore separating the release-control stop member 5 (the inner sliding rail 1) from the intermediate sliding rail 2 is easy. The orthopedically engineered design of the flat front operating portion 551 of the front operating handle 55 can easily be operated with less effort.

2. When wishing to separate the inner sliding rail 1 from the intermediate sliding rail 2, the user can pull the operating handle 55 of the release-control stop member 5 with the fingers with less effort. Simply pulling the flat front operating portion 551 of the front operating handle 55 of the release-control stop member 5 straightly forwards, the arched neck 54 is deformed to force the locating notch 523 away from the retaining portion 43 of the locating block 4.

3. The release-control stop member 5 is a single piece element directly injection-molded from plastics for quick installation with less labor, thereby lowering the cost.

In the aforesaid preferred embodiment of the present invention, the release-control stop member 5 is used in a three-section sliding rail assembly having an inner sliding rail, an intermediately sliding rail and an outer rail. Alternatively, the release-control stop member 5 can be used in a two-section sliding rail assembly having an outer rail and an inner sliding rail. In this case, the stop block 4 is affixed to the outer rail, and the release-control stop member 5 is affixed to the inner sliding rail.

Although a particular embodiment of the present invention has been described in detail for purposes of illustration, various modifications and enhancements may be made without departing from the spirit and scope of the invention. Accordingly, the invention is not to be limited except as by the appended claims.

What is claimed is:

1. A release control stop member injection-molded from plastics and affixed to a first sliding rail being inserted into a second sliding rail having a locating block and adapted to stop said first sliding rail from falling out of said second sliding rail, the release-control stop member comprising:

a flat rear engagement block, a front operating handle, and an arched neck connected between said flat rear engagement block and said front operating handle, said flat rear engagement block having a rear mounting hole configured to be, when mounted to the first sliding rail, fastened to a rear side of the first sliding rail, a first side edge shaped to be disposed adjacent a first vertical sidewall of the first sliding rail, a second side edge shaped to be disposed adjacent to a second vertical sidewall of the first sliding rail, a narrow front connecting portion, and a locating notch defined between said second side edge and said narrow front connecting portion configured for engagement with the locating block of the second sliding rail to stop the first sliding rail from falling out of the second sliding rail after the first sliding rail has been pulled out of the second sliding rail, said second side edge of said flat rear engagement block extending obliquely backwardly inwards, said narrow front connecting portion having a front end terminating in a rear end of said arched neck, said arched neck being configured to be smoothly curved toward said second vertical sidewall of the second sliding rail, said front operating handle having a flat front operating portion and a finger block at said flat front operating portion for gripping with the fingers of a human being, said flat front operating portion being relatively broader than the other part of said front operating handle, the width of said flat front operating portion being configured to be not greater than the pitch between a first upright sidewall and a second upright sidewall of the second sliding rail.

2. The release-control stop member as claimed in claim 1, wherein said flat front operating portion of said front operating handle has two opposite lateral sides smoothly arched.

3. The release-control stop member as claimed in claim 1, wherein said finger block of said front operating handle of said release-control stop member is chamfered; said flat front operating portion of said front operating handle has a slot therein on the middle.

* * * * *